US010738554B2

(12) United States Patent
Alssafwany

(10) Patent No.: US 10,738,554 B2
(45) **Date of Patent: *Aug. 11, 2020**

(54) REPULSION FORCE SYSTEMS AND METHODS FOR METAL FISH RETRIEVAL

(71) Applicant: Saudi Arabian Oil Company, Dhahran (SA)

(72) Inventor: Ali Radi Alssafwany, Safwa (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 144 days.

This patent is subject to a terminal disclaimer.

(21) Appl. No.: 16/003,963

(22) Filed: Jun. 8, 2018

(65) Prior Publication Data

US 2019/0376357 A1 Dec. 12, 2019

(51) Int. Cl.

| | |
|---|---|
| ***E21B 31/00*** | (2006.01) |
| ***E21B 31/06*** | (2006.01) |
| ***E21B 31/18*** | (2006.01) |
| ***E21B 31/20*** | (2006.01) |

(52) U.S. Cl.

CPC ..... *E21B 31/06* (2013.01); *E21B 31/00* (2013.01); *E21B 31/18* (2013.01); *E21B 31/20* (2013.01)

(58) Field of Classification Search

CPC ..... E21B 23/04; E21B 31/00; E21B 31/18; E21B 31/20; E21B 31/14; E21B 47/00; E21B 47/0002; E21B 47/12; E21B 31/107; E21B 17/1021; E21B 4/18; E21B 47/02; E21B 2013/008; E21B 23/00; E21B 31/06

See application file for complete search history.

(56) References Cited

U.S. PATENT DOCUMENTS

| | | | | |
|---|---|---|---|---|
| 2,092,316 A | | 9/1937 | Lane | |
| 2,709,104 A | | 5/1955 | Gibbs | |
| 3,268,003 A | | 8/1966 | Essary | |
| 3,441,307 A | * | 4/1969 | Farmer | E21B 31/06 294/65.5 |
| 3,905,631 A | | 9/1975 | Ricks et al. | |

(Continued)

FOREIGN PATENT DOCUMENTS

| | | |
|---|---|---|
| CN | 202611645 U | 12/2012 |
| WO | 2004057149 A1 | 7/2004 |

OTHER PUBLICATIONS

International Search Report and Written Opinion for related PCT application PCT/US2019/035311 dated Sep. 16, 2019.

*Primary Examiner* — Yong-Suk Ro

(74) *Attorney, Agent, or Firm* — Bracewell LLP; Constance G. Rhebergen; Linda L. Morgan

(57) ABSTRACT

A fishing tool used for fishing a metal object from a subterranean well has a housing. The housing is an elongated member having an internal bore. A first electromagnetic assembly is located within the internal bore of the housing and a second electromagnetic assembly is located at an outer diameter surface of the housing. The second electromagnetic assembly moves between a contracted position and an extended position. The second electromagnetic assembly extends outward from the housing. The first electromagnetic assembly generates a first magnetic force with an adjustable magnitude. The second electromagnetic assembly generates a second magnetic force with an adjustable magnitude. The first magnetic force and the second magnetic force have the same magnetic polarity.

15 Claims, 3 Drawing Sheets

(56) References Cited

U.S. PATENT DOCUMENTS

| | | | | |
|---|---|---|---|---|
| 4,488,747 | A * | 12/1984 | Austin | E21B 31/007 294/86.1 |
| 5,022,484 | A * | 6/1991 | Panetta | E21B 47/026 181/102 |
| 6,629,562 | B1 | 10/2003 | Fidan | |
| 7,358,183 | B2 | 4/2008 | Fukuchi | |
| 7,874,364 | B2 | 1/2011 | Redlinger et al. | |
| 9,308,608 | B2 | 4/2016 | Townsend et al. | |
| 2006/0164917 | A1 | 7/2006 | Ganesan et al. | |
| 2012/0048552 | A1* | 3/2012 | MacDougall | E21B 31/125 166/301 |
| 2016/0273293 | A1* | 9/2016 | Surjaatmadja | E21B 29/005 |
| 2019/0301258 | A1* | 10/2019 | Li | E21B 17/1021 |

* cited by examiner

REPULSION FORCE SYSTEMS AND METHODS FOR METAL FISH RETRIEVAL

BACKGROUND OF THE DISCLOSURE

1. Field of the Disclosure

The present disclosure relates to subterranean well developments, and more specifically, the disclosure relates to removing stuck fish from the subterranean well.

2. Description of the Related Art

In hydrocarbon development operations it is not uncommon for an object to get stuck or unintentionally left within the bore of a subterranean well. This stuck or left object is known as a fish. A fish may have one of a variety of unspecified sizes or shapes and can be, for example, as small around as a wire or have a diameter as large as a drill pipe.

SUMMARY OF THE DISCLOSURE

Embodiments of this disclosure include systems and methods for using electromagnetic field generators for retrieving downhole metal fish within a subterranean well. Two separate electromagnetic assemblies generate the required repulsion force at the stuck point of the fish to unstick the fish from the well string.

In an embodiment of this disclosure, a system for fishing a metal object from a subterranean well includes a fishing tool with housing, the housing being an elongated member having an internal bore. A first electromagnetic assembly is located within the internal bore of the housing. A second electromagnetic assembly is located at an outer diameter surface of the housing, the second electromagnetic assembly being moveable between a contracted position and an extended position, and where the second electromagnetic assembly extends outward from the housing. The first electromagnetic assembly is operable to generate a first magnetic force with an adjustable magnitude. The second electromagnetic assembly is operable to generate a second magnetic force with an adjustable magnitude. The first magnetic force and the second magnetic force have a same magnetic polarity.

In alternate embodiments, the first electromagnetic assembly can be located proximate to a first end of the housing. The internal bore of the housing is open at the first end of the housing. The first electromagnetic assembly can be operable to attract the metal object and releasably secure the metal object to the fishing tool. The internal bore of the housing can be sized to receive the metal object within the internal bore of the housing.

In other alternate embodiments, the second electromagnetic assembly can be sized to contact a well string in the extended position. The second electromagnetic assembly can be positioned to be spaced apart from the well string in the contracted position. The well string can be formed of a metal. A second end of the housing can be secured to an installation member, the installation member extending from a surface and into a well string.

In another embodiment of this disclosure, a system for fishing a metal object from a subterranean well includes a fishing tool with housing located within a well string of the subterranean well, the housing being an elongated member having an internal bore. A first electromagnetic assembly is located within the internal bore of the housing and in contact with the metal object. A second electromagnetic assembly is located at an outer diameter surface of the housing. The second electromagnetic assembly is moveable between a contracted position where the second electromagnetic assembly is spaced apart from the well string and an extended position where the second electromagnetic assembly extends outward from the housing and is in contact with the well string. The first electromagnetic assembly is operable to generate a first magnetic force with an adjustable magnitude and magnetize the metal object. The second electromagnetic assembly is operable to generate a second magnetic force with an adjustable magnitude and magnetize the well string. The first magnetic force and the second magnetic force have a same magnetic polarity.

In alternate embodiments, the internal bore of the housing can be open at the first end of the housing and is sized to receive the metal object within the internal bore of the housing. The first electromagnetic assembly can be operable to attract the metal object and releasably secure the metal object to the fishing tool. A second end of the housing can be secured to an installation member. The installation member extends from a surface and into the well string and supports the fishing tool within the well string.

In yet another alternate embodiment of this disclosure, a method for fishing a metal object from a subterranean well includes providing a fishing tool with housing, the housing being an elongated member having an internal bore. A first electromagnetic assembly is located within the internal bore of the housing. A second electromagnetic assembly is located at an outer diameter surface of the housing. The second electromagnetic assembly is moveable between a contracted position and an extended position where the second electromagnetic assembly extends outward from the housing. A first magnetic force is generated with an adjustable magnitude with the first electromagnetic assembly. A second magnetic force is generated with an adjustable magnitude with the second electromagnetic assembly. The first magnetic force and the second magnetic force have a same magnetic polarity.

In alternate embodiments, the method can further include attracting the metal object and releasably securing the metal object to the fishing tool with the first electromagnetic assembly. The metal object can be magnetized with the first magnetic force. The well string can be magnetized with the second magnetic force.

In other alternate embodiments, the first electromagnetic assembly can be located proximate to a first end of the housing. The internal bore of the housing can be open at the first end of the housing and the internal bore of the housing can be sized to receive the metal object within the internal bore of the housing. The second electromagnetic assembly can be sized to contact a well string in the extended position and can be positioned to be spaced apart from the well string in the contracted position. A second end of the housing can be secured to an installation member. The installation member extends from a surface and into a well string and supports the fishing tool within the well string.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
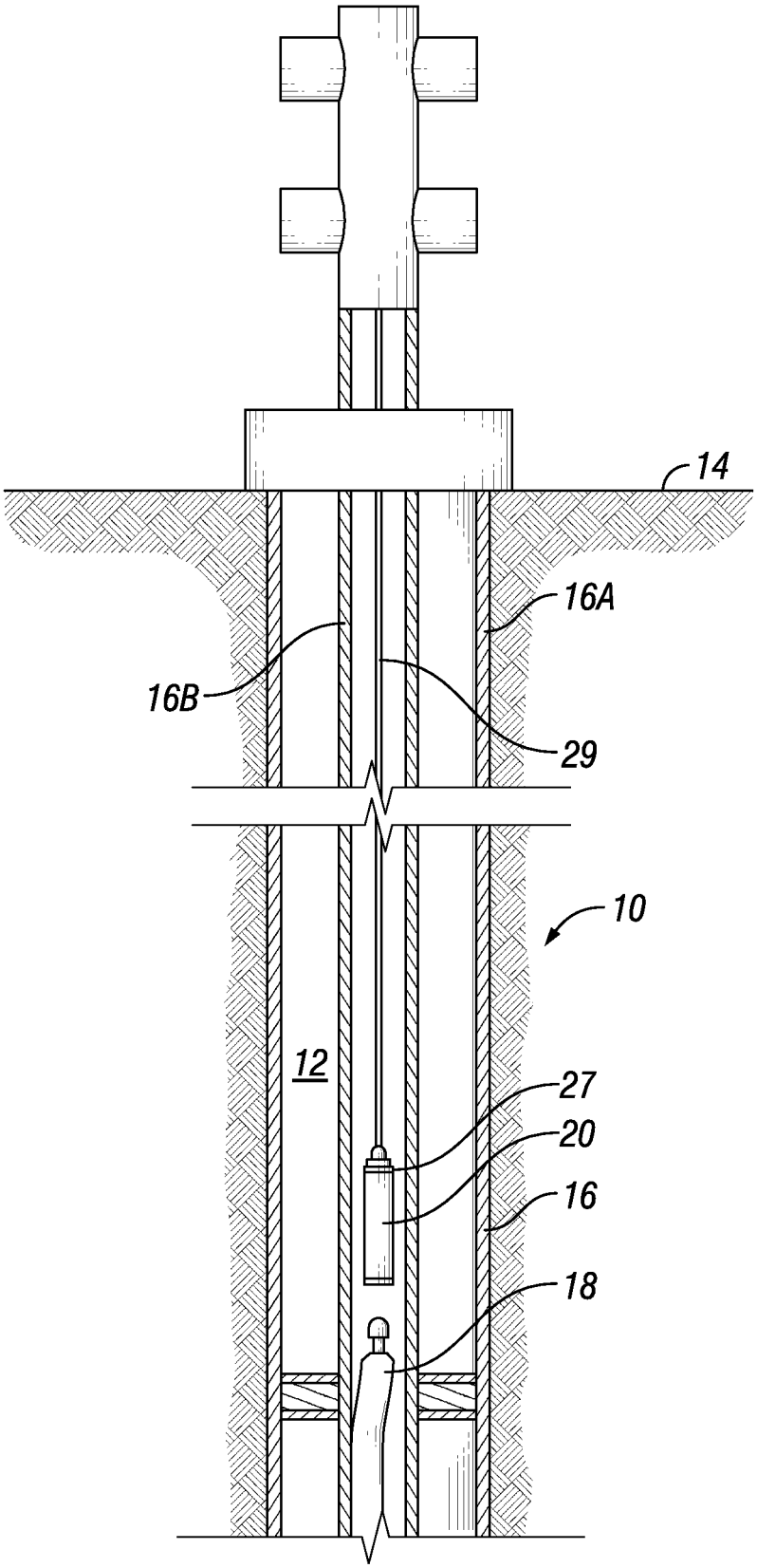
FIG. 1 is a section view of a subterranean well with a fishing tool in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Well string 16 can be lowered into and located within wellbore 12. In alternate examples, well string 16 can be a casing, tubing, or liner of subterranean well 10. There can be more than one well string 16. In the example of FIG. 1, there are two well strings 16, outer casing 16*a* and production tubular 16*b*. Well string 16 is a tubular member that can extend from surface 14 into subterranean well 10, or that can be suspended within subterranean well 10 a distance from surface 14. Well string 16 can be formed of a ferromagnetic material, such as a metal.

Operations that take place in relation to subterranean well 10 can sometimes lead to a metal object 18 becoming stuck of left within well string 16. Metal object 18 can be, for example, junk metal, a hand tool, a length of drill pipe or collar, a plug, a packer, drilling bits, a part of the hydrocarbon completion, coiled tubing wireline accessories, or debris that ends up within well string 16. Such metal object 18 can be known as a "fish." Metal object 18 can be stuck or left within well string 16 during, as an example, drilling, workover, or well intervention operations with a slick line, wireline, or coiled tubing. Fishing tool 20 can be used to remove metal object 18.

Figure 2:
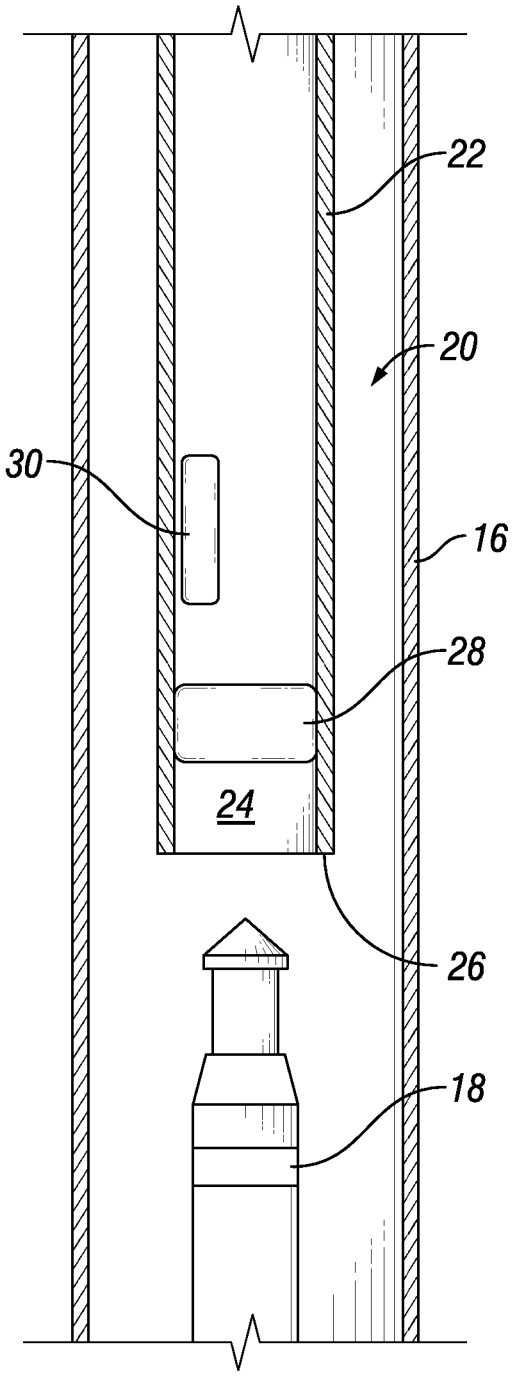
FIG. 2 is a schematic section view of a fishing tool located in a subterranean well in accordance with an embodiment of this disclosure, shown with a second electromagnetic assembly in the contracted position.
Figure 3:
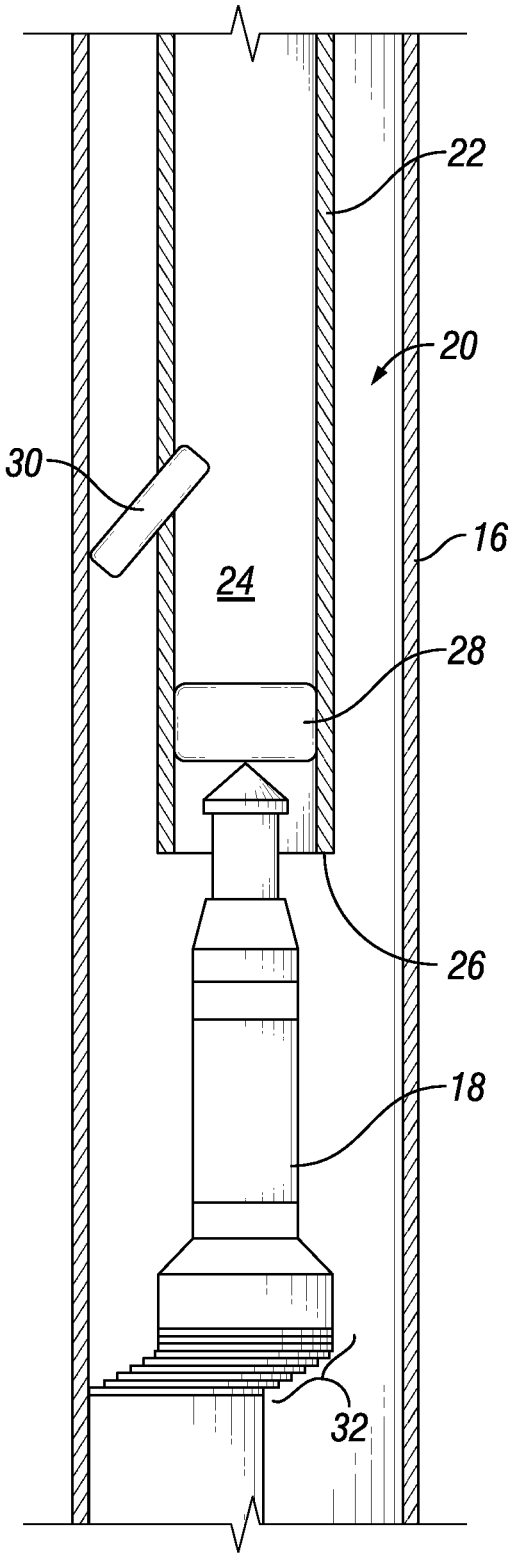
FIG. 3 is a schematic section view of a fishing tool located in a subterranean well in accordance with an embodiment of this disclosure, shown with the second electromagnetic assembly in the extended position.

Looking at FIGS. 2-3, fishing tool 20 can include housing 22. Housing 22 is an elongated member having internal bore 24. Internal bore 24 of housing 22 is open at a downhole or first end 26 of housing 22. Internal bore 24 of housing 22 can be sized to receive metal object 18 within internal bore 24 of housing 22. Housing 22 can be formed of a non-magnetic material such as, for example, stainless steel or tungsten carbide.

Fishing tool 20 also includes first electromagnetic assembly 28 that is located within internal bore 24 of housing 22. First electromagnetic assembly 28 is located proximate to first end 26 the housing 22. Internal bore 24 of housing 22 is shown as extending from first end 26 of housing 22 and past first electromagnetic assembly 28. In alternate embodiments internal bore 24 can be sized with a length suitable for housing first electromagnetic assembly 28 and metal object 18 and the remaining length of housing 22 can be a solid member.

First electromagnetic assembly 28 is operable to generate a first magnetic force with an adjustable magnitude. The magnitude of the first magnetic force can be adjusted to attract metal object 18 and releasably secure metal object 18 to fishing tool 20. If metal object 18 is loose within well string 16, then first electromagnetic assembly 28 can be used to secure metal object 18 to or within fishing tool as fishing tool 20 together with metal object 18 are returned to the surface. The magnitude of the first magnetic force is equal to or greater than the weight of metal object 18. If metal object 18 is stuck within well tubing 16, the first magnetic force can be used to magnetize metal object 18 to unstick metal object 18, as described in this disclosure.

Uphole or second end 27 of housing 22 is secured to installation member 29. Installation member 29 can be, for example, a wireline or coiled tubing that extends from a surface and into well string 16. Installation member 29 can be used to lower fishing tool 20 into subterranean well 10, remove fishing tool 20 from subterranean well 10, and support fishing tool 20 within well string 16. Fishing tool 20 can have sufficient strength to tolerate a pulling force of up to 25,000 pounds (lbs) for applications where installation member 29 is a wireline and up to 70,000 lbs for applications where installation member 29 is coiled tubing.

Fishing tool 20 further includes second electromagnetic assembly 30 that can be located at an outer diameter surface of housing 22. Second electromagnetic assembly 30 is moveable between a contracted position (FIG. 2) and an extended position (FIG. 3). In the contracted position, second electromagnetic assembly 30 is spaced apart from well string 16. In the extended position second electromagnetic assembly 30 extends outward from housing 22 and is in contact with well string 16. Second electromagnetic assembly 30 can move between the contracted position and the extended position with a dedicated actuator which can be, for example, a hydraulic type system. Alternately, second electromagnetic assembly 30 can move between the contracted position and the extended position with a motor that is operated electrically or can be energized by utilizing a pumping force of a wellbore fluid flowing through wellbore 12. First electromagnetic assembly 28 and second electromagnetic assembly 30 can be powered and controlled by a surface controller (not shown) that is located at surface 14.

Second electromagnetic assembly 30 can generate a second magnetic force with an adjustable magnitude. With second magnetic assembly in the extended position, the second magnetic force can be used to magnetize well string 16. The first magnetic force and the second magnetic force have the same magnetic polarity. In this way, where metal object 18 is in contact with or proximate to well string 16 and causing metal object 18 to be stuck, a repulsive magnetic force between metal object 18 and well string 16 will act to push metal object 18 away from well string 16. The magnitude of both first magnetic force and second magnetic force can be adjusted to provide sufficient repulsive force to unstick metal object 18 from well string 16.

Looking at FIG. 3, mid-region 32 of metal object 18 can be a length of considerable distance such as a distance up to hundreds of feet long. Mid-region 32 of metal object 18 can include a portion of metal object 18 that is in contact with well string 16, causing the sticking of metal object 18 within well string 16. In such a situation where the location of sticking of metal object 18 in well string 16 is a distance from fishing tool 20, the magnetic field of the first magnetic force can travel through metal object 18 and the magnetic field of the second magnetic force can travel through well string 16 so that the location of the repulsive force required to unstick metal object 18 from well string 16 is applied at the distance from fishing tool 20 where metal object 18 meets well string 16.

After using a repulsive force to unstick metal object 18 from well string 16, metal object 18 can be releasably secured to fishing tool 20 so that when fishing tool 20 is removed from subterranean well 10 metal object 18 is coupled to and removed with fishing tool 20. Because metal object 18 has been unstuck from well string 16 before applying a pulling force for removing fishing tool 20 from subterranean well 10, the magnitude of the pulling force required to retrieve metal object 18 will be reduced compared to systems where the pulling force is additionally used to also unstick metal object 18.

In addition, the first magnetic force generated by first electromagnetic assembly 28 that releasably secures metal object 18 to fishing tool 20 can have a magnitude necessary to draw metal object 18 out of subterranean well 10 only after metal object 18 is unstuck. The magnitude of this attractive force is reduced compared to systems where an attractive magnetic force may further be used to also unstick metal object 18 from well string 16.

In an example of operation in order to fish metal object 18 from subterranean well 10, fishing tool 20 can be lowered into well string 16 with installation member 29. Fishing tool 20 can be positioned within well string 16 so that first electromagnetic assembly 28 contacts or is proximate to metal object 18 so as to be capable of influencing metal object 18 with a first magnetic field. Second electromagnetic assembly 30 can be moved to the extended position so that second electromagnetic assembly 30 is in contact with well string 16.

A first magnetic force with an adjustable magnitude can be generated with first electromagnetic assembly 28 and can magnetize metal object 18. A second magnetic force with an adjustable magnitude can be generated with second electromagnetic assembly 30 and can magnetize well string 16. Because the first magnetic force and the second magnetic force have the same magnetic polarity, a repulsive force is generated that will act to push metal object 18 away from well string 16 so that metal object 18 becomes unstuck from well string 16. After metal object 18 is unstruck, first electromagnetic assembly 28 can attract and releasably secure metal object 18 to fishing tool 20. Fishing tool 20 with metal object 18 can then be pulled to the surface so that metal object 18 is removed from subterranean well 10.

Embodiments described in this disclosure therefore provide for the utilization of electromagnetics in order to generate repulsion force and release a stuck metal object from a well string. After being released, the unstuck metal object and tool can be more easily fished to the surface using a reduced pulling force compared to using a pulling force for unsticking the metal object. Systems and methods of this disclosure can be used to remove stuck metal objects of a variety of shapes and sizes since a magnetic force is used for the removal instead of a physical latching mechanism. In addition, systems and methods of this disclosure reduce the risk of damage to the well string, fish, and cement integrity compared to methods of retrieving a stuck fish by using pulling, jarring, or vibrational techniques.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for fishing a metal object from a subterranean well, the system including:

a fishing tool with housing, the housing being an elongated member having an internal bore;

a first electromagnetic assembly located within the internal bore of the housing; and a second electromagnetic assembly located at an outer diameter surface of the housing, the second electromagnetic assembly being moveable between a contracted position and an extended position where the second electromagnetic assembly extends outward from the housing; where the first electromagnetic assembly is operable to generate a first magnetic force with an adjustable magnitude; and the second electromagnetic assembly is operable to generate a second magnetic force with an adjustable magnitude, the first magnetic force and the second magnetic force having a same magnetic polarity.

2. The system of claim 1, where the first electromagnetic assembly is located proximate to a first end of the housing, where the internal bore of the housing is open at the first end of the housing.

3. The system of claim 1, where the first electromagnetic assembly is operable to attract the metal object and releasably secure the metal object to the fishing tool.

4. The system of claim 1, where the internal bore of the housing is sized to receive the metal object within the internal bore of the housing.

5. The system of claim 1, where the second electromagnetic assembly is sized to contact a well string in the extended position.

6. The system of claim 5, where the second electromagnetic assembly is positioned to be spaced apart from the well string in the contracted position.

7. The system of claim 5, where the well string is formed of a metal.

8. The system of claim 1, where a second end of the housing is secured to an installation member, the installation member extending from a surface and into a well string.

9. A method for fishing a metal object from a subterranean well, the method including:

providing a fishing tool with housing, the housing being an elongated member having an internal bore;

locating a first electromagnetic assembly within the internal bore of the housing; and locating a second electromagnetic assembly at an outer diameter surface of the housing, the second electromagnetic assembly being moveable between a contracted position and an extended position where the second electromagnetic assembly extends outward from the housing;

generating a first magnetic force with an adjustable magnitude with the first electromagnetic assembly; and generating a second magnetic force with an adjustable magnitude with the second electromagnetic assembly, where the first magnetic force and the second magnetic force have a same magnetic polarity.

10. The method of claim 9, further including attracting the metal object and releasably securing the metal object to the fishing tool with the first electromagnetic assembly.

11. The method of claim 9, further including magnetizing the metal object with the first magnetic force.

12. The method of claim 9, further including magnetizing a well string with the second magnetic force.

13. The method of claim 9, further including locating the first electromagnetic assembly proximate to a first end of the housing, and where the internal bore of the housing is open at the first end of the housing and the internal bore of the housing is sized to receive the metal object within the internal bore of the housing.

14. The method of claim 9, where the second electromagnetic assembly is sized to contact a well string in the extended position and is positioned to be spaced apart from the well string in the contracted position.

15. The method of claim 9, where a second end of the housing is secured to an installation member, the installation member extending from a surface and into a well string and supporting the fishing tool within the well string.

* * * * *